US008232729B2

(12) United States Patent
Kitano et al.

(10) Patent No.: US 8,232,729 B2
(45) Date of Patent: Jul. 31, 2012

(54) PLASMA PRODUCING APPARATUS AND METHOD OF PLASMA PRODUCTION

(75) Inventors: Katsuhisa Kitano, Osaka (JP); Satoshi Hamaguchi, Osaka (JP); Hironori Aoki, Osaka (JP)

(73) Assignee: Osaka University, Osaka (JP)

( * ) Notice: Subject to any disclaimer, the term of this patent is extended or adjusted under 35 U.S.C. 154(b) by 461 days.

(21) Appl. No.: 12/518,737

(22) PCT Filed: Jun. 12, 2007

(86) PCT No.: PCT/JP2007/061837
§ 371 (c)(1),
(2), (4) Date: Jun. 11, 2009

(87) PCT Pub. No.: WO2008/072390
PCT Pub. Date: Jun. 19, 2008

(65) Prior Publication Data

US 2010/0019677 A1 Jan. 28, 2010

(30) Foreign Application Priority Data

Dec. 12, 2006 (JP) ..... 2006-334800

(51) Int. Cl.
*H05H 1/24* (2006.01)

(52) U.S. Cl. ..... 315/111.21; 313/231.31

(58) Field of Classification Search ..... 315/111.21; 313/231.31; 156/345.33, 345.35
See application file for complete search history.

(56) References Cited

U.S. PATENT DOCUMENTS 5,236,512 A * 8/1993 Rogers et al. ..... 156/345.43
5,316,739 A 5/1994 Yoshikawa et al.
6,652,069 B2 * 11/2003 Toda et al. ..... 347/45
(Continued)

FOREIGN PATENT DOCUMENTS

JP 6-065739 A 3/1994
(Continued)

OTHER PUBLICATIONS

Kitano, K. "Discharge Mechanisms of the Atmospheric Pressure Plasma Jet Generated by Lower-frequency HV Power Supply", Japan Society of Plasma Science and Nuclear Fusion Research Proceedings of 23rd Annual Meeting, Nov. 28 to Dec. 1, 2006. Partial English translation.

(Continued)

*Primary Examiner* — Jacob Y Choi
*Assistant Examiner* — Ephrem Alemu
(74) *Attorney, Agent, or Firm* — Hamre, Schumann, Mueller & Larson, P.C.

(57) ABSTRACT

For production of plasma from a medium gas mass in an elongated shape, electric field forming elements 3, 4 that form an electric field in the medium gas mass are provided. The electric field forming elements form an electric field so that partial discharge occurs from the electric field forming elements toward both sides in the longitudinal direction of the medium gas mass. Accordingly, plasma 5 is produced from the medium gas mass. The medium gas mass is formed by, for example, gas supply members 1,2 that guide medium gas, through an internal hollow, to the electric field forming elements. An electric field forming area includes, for example, at least one high-potential electrode 3 and a voltage applying unit 4 that applies a voltage to the high-potential electrode. Plasma limited in medium gas can be produced with high energy efficiency stably over a wide range of parameters through a simple configuration.

9 Claims, 8 Drawing Sheets

U.S. PATENT DOCUMENTS

| | | | | |
|---|---|---|---|---|
| 7,576,297 | B2 * | 8/2009 | Fujita et al. | 219/121.36 |
| 2004/0129220 | A1 | 7/2004 | Saitoh et al. | |
| 2008/0063576 | A1 | 3/2008 | Ichiki | |

FOREIGN PATENT DOCUMENTS

| | | | |
|---|---|---|---|
| JP | 2002-313599 | A | 10/2002 |
| JP | 2002-368389 | * | 12/2002 |
| JP | 2002-368389 | A | 12/2002 |
| JP | 2003-282443 | A | 10/2003 |
| JP | 2004-111948 | A | 4/2004 |
| JP | 2005-267975 | A | 9/2005 |
| JP | 2006-060130 | A | 3/2006 |
| WO | WO 2006/001455 | A1 | 1/2006 |

OTHER PUBLICATIONS

Kitano, K. "Characteristics of glow plasmas generated upon and inside water by atmospheric pressure RF barrier discharge", 6th Lecture Meeting of Nuclear Fusion Energy Association, Jun. 13 to 14, 2006. Partial English translation.

Kitano, K. "Generation and properties of atmospheric-pressure plasma in contact with liquids", the 67th Autumn Meeting, 2006, The Japan Society of Applied Physics, Aug. 29 to Sep. 1, 2006. Partial English translation.

* cited by examiner

PLASMA PRODUCING APPARATUS AND METHOD OF PLASMA PRODUCTION

TECHNICAL FIELD

The present invention relates to the production of microplasma, and in particular, to a plasma producing apparatus for producing plasma limited in medium gas and a method of plasma production.

BACKGROUND ART

Recently, a microplasma jet is drawing attention due to its wide applicability, and has been realized by various power sources and electrode structures. The microplasma is characterized by a minute spatial size. In order to produce and keep plasma in a minute space, the medium density must increases so as to ensure the sufficient collision frequency between electrons/ions and atomic molecules of medium gas (plasma-producing gas). Therefore, the production of microplasma requires medium gas in the vicinity of an atmospheric pressure, i.e., medium gas with a density of about $10^{18}$ to $10^{22}$ $cm^{-3}$.

Furthermore, generally, in the case of plasma on a conventional microscale, an electron temperature Te and a gas temperature Tg in the plasma reach almost the thermal equilibrium along with the increase in a working pressure, so that such plasma is called thermal equilibrium plasma. In contrast, in a region of microplasma, which has a size of μm scaled down from several mm, the energy is not transferred sufficiently by the collision between particles because of a shortened duration period $\tau_d$ of medium gas molecules in the plasma, and the non-equilibrium state of Te>>Tg is considered to be obtained as in low-pressure plasma.

Conventionally, a microplasma jet is produced in most cases by an afterglow system using plasma with a temperature thereof decreased. According to the afterglow system, plasma at a relatively high temperature produced inside a quartz pipe through which medium gas flows is pushed by a medium gas stream and blown out from the tip end of the pipe.

For example, according to a system described in Patent Document 1, argon (Ar) gas used as medium gas for producing plasma is allowed to flow into a quartz pipe and is jetted from a jet port. A coil is placed around the quartz pipe and a high-frequency current is induced to flow therethrough, whereby an induction electric field is generated in the quartz pipe. Argon atoms of the argon gas flowing into the quartz pipe are ionized in the induction electric field or magnetic field to become plasma at a high temperature (6,000 to 7,000° C.), and the plasma thus produced is pushed by the flow-in pressure of the argon gas to be jetted to the atmosphere from the jet port at the tip end of the quartz pipe. The jetted plasma generates a microplasma jet without being diffused due to the presence of the atmosphere.

On the other hand, as a system different from those described above, a system as shown in FIG. 11 is known, which has been proposed by Engemann et al. of Wuppertal University in Germany. In FIG. 11, reference 1 denotes a gas supply tube made of a quartz pipe with an inner diameter of about 2 to 5 mm, and helium gas having passed through an internal hollow thereof is jetted from a jet port 1*a*. A pair of coaxial electrodes 3*a*, 3*b* for producing plasma are placed at upstream and downstream positions on the outer circumference of an end of the gas supply tube 1 on the jet port 1*a* side. A low-frequency pulse voltage of about 10 kHz (for example, 6-12 kV, 13 kHz) is applied to the electrodes 3*a*, 3*b* to cause pulse discharge by a voltage applying unit 4, with the electrode 3*a* being at a ground potential and the electrode 3*b* being at a high potential, whereby a plasma jet (hereinafter, which also may be referred to as a low-frequency (LF) plasma jet) extending in an elongated shape from the jet port 1*a* is generated.

The LF plasma jet has unusual features in two aspects. First, unlike a plasma jet according to the afterglow system, a plasma jet that extends in an elongated shape and has a large ratio of a length to a diameter (i.e., aspect ratio) is obtained, and the jetting direction is determined in accordance with the direction of a voltage to be applied to the electrodes. More specifically, when the direction of a voltage to be applied to the electrodes is inverted, the jet extends in an opposite direction, i.e., in an upstream direction of gas. Furthermore, according to the high time resolution measurement, columnar discharge is not maintained, and a spherical plasma bullet is moving at a very high speed of 10 km/s, which is about 10,000 times that of a medium gas stream, in synchronization with the power source frequency. Thus, the production mechanism is not directly related to the medium gas stream.

Unlike the afterglow jet, in the plasma jet according to the above system, a medium gas stream is ionized to become plasma, so that the plasma can be radiated directly to an object. Furthermore, in the LF plasma jet, a pulse-shaped plasma bullet is jetted. Therefore, non-equilibrium in terms of time is created, i.e., a thermal non-equilibrium state is created since the energy cannot be transferred to neutral gas at each moment. The thermal non-equilibrium plasma can radiate a high-energy component without raising the temperature of the object.

Patent document 1: JP 2006-60130 A

DISCLOSURE OF INVENTION

Problem To Be Solved By the Invention

As described above, according to the LF plasma jet system, a high potential is applied to the electrode 3*b*, whereby a plasma jet 5 extends in a downstream direction with respect to the medium gas stream. However, it was found that the jetting direction is not determined by the position of the electrode 3*b* on a high potential side with respect to the electrode 3*a* on a ground potential side.

More specifically, a plasma jet is produced only due to the presence of the electrode 3*b* to which a high potential is applied, and the electrode 3*a* at a ground potential tends to suppress the flow of the jet. On the downstream side in the medium gas stream with respect to the electrode 3*b* at a high potential, partial discharge occurs between the high potential portion and the ground potential portion present distant from the high potential portion. Furthermore, the discharge produces plasma limited in a medium, which is produced only in the medium gas stream, such as that obtained when the medium gas stream is ionized to become plasma. On the other hand, on the upstream side in the medium gas stream with respect to the electrode 3*b* at a high potential, discharge occurs due to the short-circuit between electrodes covered with a dielectric barrier, because the interval between the electrode 3*b* at a high potential and the electrode 3*a* at a ground potential is small. Unlike partial discharge, the discharge caused by a short-circuit has high power consumption and involves the generation of heat. It was found that the two-electrode system has poor efficiency since such short-circuit discharge occurs.

Furthermore, the discharge mechanism of the LF plasma jet is not known, so that the dischargeable range under various parameters is limited.

Thus, an object of the present invention is to provide a plasma producing apparatus capable of producing plasma limited in medium gas with high energy efficiency stably over a wide range of parameters through a simple configuration, and a method of plasma production.

Means for Solving Problem

In order to solve the above problem, a plasma producing apparatus with a first configuration of the present invention, which produces plasma from a medium gas mass in an elongated shape, includes an electric field forming element that forms an electric field in the medium gas mass. The electric field forming element forms an electric field so that partial discharge occurs from the electric field forming element toward both sides in a longitudinal direction of the medium gas mass.

A plasma producing apparatus with a second configuration of the present invention, which produces plasma from a medium gas mass in an elongated shape, includes a single high-potential electrode placed in the medium gas mass, and a voltage applying element that applies a voltage to the high-potential electrode. The voltage applying element applies a voltage, which forms an electric field causing partial discharge from the high-potential electrode toward both sides in a longitudinal direction of the medium gas mass, to the high-potential electrode.

A first method of plasma production of the present invention is for producing plasma from a medium gas mass in an elongated shape by an electric field forming element that forms an electric field in the medium gas mass. The electric field is formed in the medium gas mass by the electric field forming element so that partial discharge occurs from the electric field forming element toward both sides in a longitudinal direction of the medium gas mass.

A second method of plasma production of the present invention is for producing plasma from a medium gas mass in an elongated shape by an electric field forming element that forms an electric field in the medium gas mass. A single high-potential electrode is placed in the medium gas mass, and a voltage, which forms an electric field causing partial discharge from the electric field forming element toward both sides in a longitudinal direction of the medium gas mass, is applied to the high-potential electrode.

In the present specification, the partial discharge refers to a phenomenon in which, when a voltage is applied between electrodes, atmospheric gas between the electrodes is discharged therebetween partially, and does not include the discharge in which the area between the electrodes is short-circuited completely. Such partial discharge occurs when there is a non-uniform electric field distribution, a non-uniform gas distribution with varying breakdown voltages, or the like. For example, when the electrode has a sharp structure instead of a parallel plate structure, an electric field is concentrated at the tip end of the electrode, and the intensity of the electric field increases. If the intensity of the electric field exceeds the breakdown electric field of the atmospheric gas, partial discharge occurs only in this portion.

The use of such partial discharge is based on the finding by the inventors of the present invention regarding the discharge mechanism of an LF plasma jet. More specifically, the discharge mechanism of the LF plasma jet is considered as follows: a streamer corona discharge phenomenon caused by the concentrated intensity of an electric field in the vicinity of a high-voltage electrode occurs along a helium gas flux in the atmosphere or in a glass tube.

Effects of the Invention

In the LF plasma jet producing apparatus and production method of the present invention, an electric field is formed in a medium gas mass in an elongated shape so that partial discharge occurs in a longitudinal direction thereof, whereby plasma can be produced with high energy efficiency stably over a wide range of parameters through a simple configuration.

DESCRIPTION OF REFERENCE NUMERALS

Figure 1A:
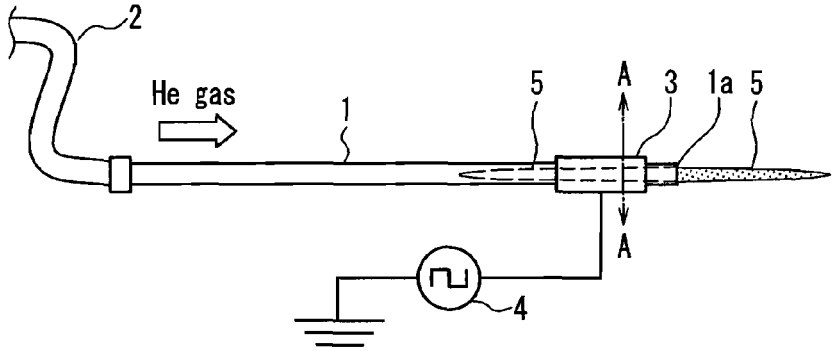
FIG. 1A is a front view showing an LF plasma jet producing apparatus in Embodiment 1 of the present invention.

1 gas supply tube
1*a* jet port
2 gas tube
3 high-potential electrode
4 voltage applying unit
5 non-equilibrium plasma jet

6, 7, 10 high-potential electrode
8 metal pipe
9 flat plate-shaped gas supply tube
11 non-equilibrium plasma jet
12 auxiliary electrode
13 auxiliary gas supply tube
14 auxiliary electrode
15 surface creepage
16 medium gas source

DESCRIPTION OF THE INVENTION

A plasma producing apparatus of the present invention can take the following various aspects on the basis of the above configuration.

More specifically, the above plasma producing apparatus with the first configuration includes a gas stream generating element that generates a medium gas stream as the medium gas mass, wherein the electric field forming element forms an electric field so that partial discharge occurs from the electric field forming element toward both an upstream side and a downstream side in the medium gas stream.

The above plasma producing apparatus with the first configuration further includes a gas supply member that guides medium gas to the electric field forming element through an internal hollow, wherein the medium gas stream is generated by the gas supply member.

Furthermore, it is preferred that the electric field forming element is capable of forming a strong electric field capable of starting partial discharge in the medium gas mass and a weak electric field capable of maintaining the partial discharge.

The above plasma producing apparatus with the second configuration further includes a gas supply member that guides medium gas to the electric field forming element through an internal hollow, wherein the medium gas stream is generated by the gas supply member.

Furthermore, the gas supply member may be made of a dielectric, and the high-potential electrode may be provided outside of the gas supply member.

Furthermore, the gas supply member may have an opening in a flat plate shape, through which the medium gas is released, and the high-potential electrode may be provided in a flat plate shape on a plate surface of the opening. Alternatively, the gas supply member may have a cylindrical structure, and the high-potential electrode may have a cylindrical structure. The function of the present invention is not substantially constrained by the cross-sectional shape of a gas flux, and the gas supply member can be formed arbitrarily in any shape other than a cylindrical shape on any place other than a plane.

Furthermore, the gas supply member may be made of a conductor, and the gas supply member may be used as the high-potential electrode.

The gas supply member may be made of a dielectric, and the high-potential electrode may be provided in an internal hollow of the gas supply member.

In this case, the high-potential electrode may be provided so as to be integrated with the gas supply member to form a part of an inner surface of the gas supply member, and the medium gas may be in contact with an inner wall surface of the gas supply member and a surface of the high-potential electrode.

Furthermore, the voltage applying element may be capable of supplying a voltage capable of starting partial discharge in the medium gas mass and a voltage capable of maintaining the partial discharge.

Furthermore, the above plasma producing apparatus with the second configuration further includes an auxiliary electrode placed at a position apart from the high-potential electrode so as to be adjacent to a part of the medium gas mass, wherein the auxiliary electrode may be supplied with a ground potential from the voltage applying element.

Furthermore, the above plasma producing apparatus with the second configuration further includes an auxiliary gas supply member that guides the medium gas through an internal hollow, and an auxiliary electrode that is provided in the auxiliary gas supply member and is supplied with a ground potential by the voltage applying element, wherein the auxiliary gas supply member may be placed so that a jet port for jetting the medium gas is in contact with a jet port for jetting the medium gas of the gas supply member or is dose to a jet port for jetting the medium gas of the gas supply member at a predetermined interval g, and at least one of the gas supply member and the auxiliary gas supply member may be made of a dielectric.

Furthermore, the above plasma producing apparatus with the second configuration may be configured so as to produce plasma from a plurality of the medium gas masses and include the high-potential electrode placed in each of the plurality of the medium gas masses.

In the above first method of plasma production, a medium gas stream may be generated as the medium gas mass, and the electric field may be formed by the electric field forming element so that partial discharge occurs from the electric field forming element toward both the upstream side and the downstream side in the medium gas stream.

Furthermore, a strong electric field capable of starting partial discharge in the medium gas mass and a weak electric field capable of maintaining the partial discharge may be formed successively by the electric field forming element.

For forming the electric field by the electric field forming element, a distance between the high-potential electrode and a ground potential portion may be set to be a predetermined distance at which the voltage applied to the high-potential electrode is capable of starting the partial discharge, and a distance between the high-potential electrode and the ground potential portion may be set to be larger than the predetermined distance in a range capable of maintaining the partial discharge.

Hereinafter, the present invention will be described by way of embodiments with reference to the drawings.

Embodiment 1

Figure 1B:
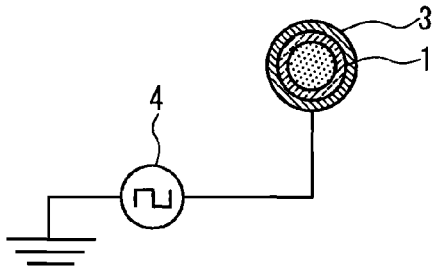
FIG. 1B is an enlarged cross-sectional view taken along a line A-A in the LF plasma jet producing apparatus in FIG. 1A.

FIGS. 1A and 1B show an LF plasma jet producing apparatus in Embodiment 1. FIG. 1A is a front view and FIG. 1B is an enlarged cross-sectional view taken along a line A-A in FIG. 1A.

A gas supply tube 1 is made of a dielectric, for example, a quartz pipe. A gas tube 2 is connected to a rear end of the gas supply tube 1, and for example, helium (He) gas is supplied to the gas supply tube 1 from a medium gas source (not shown). The helium gas having passed through an internal hollow of the gas supply tube 1 is jetted from a jet port 1*a* to constitute a gas stream generating portion for forming a gas stream of medium gas. The gas supply tube 1 has an inner diameter of, for example, 50 μm to 50 mm. In place of the quartz pipe, a pipe made of another dielectric, for example, a plastic tube, may be used.

Figure 2A:
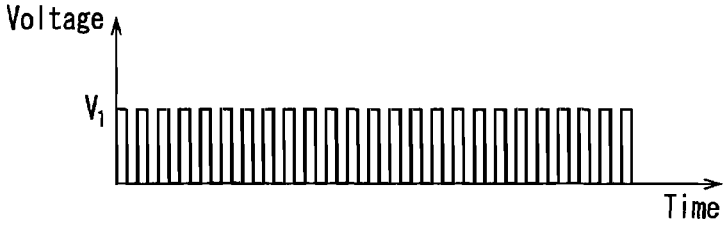
FIG. 2A is a waveform diagram showing a low-frequency voltage to be applied in the LF plasma jet producing apparatus in Embodiment 1.

A coaxial single high-potential electrode 3 for producing plasma is set on an outer circumference of an end of the gas supply tube 1 on the jet port 1*a* side. A voltage applying unit 4 is connected to the high-potential electrode 3 and can apply a positive voltage in a pulse train shape with a predetermined frequency as shown in FIG. 2A. The value of a positive voltage in a pulse train shape to be applied by the voltage applying unit 4 is set to be, for example, 10 kV, and the frequency thereof is set to be, for example, about 10 kHz, whereby the non-equilibrium plasma jet 5 that extends in an elongated shape from the jet port 1*a* is produced.

Thus, as represented by a broken line in FIG. 1A, the phenomenon is observed in which the plasma jet 5 produced only by a single high-potential electrode extends in both upstream and downstream directions of the medium gas stream from the high-potential electrode 3. Thus, this discharge is not considered as a phenomenon in which a plasma bullet bursts out to the atmosphere but as a discharge phenomenon that occurs in a cylindrical space limited in a medium by a helium gas stream. That is, on the upstream and downstream sides of the medium gas stream with respect to the high-potential electrode 3, partial discharge occurs between the high-potential electrode and the ground potential present distant therefrom, and the discharge is plasma limited in a medium that is produced only in the medium gas stream. Thus, in the LF plasma jet producing apparatus of the present embodiment, short-circuit discharge does not occur between electrodes. As a result, in both the upstream portion and the downstream portion of the high-potential electrode 3 (that is, outside of the high-potential electrode 3), plasma with a large aspect ratio is produced.

In order to generate a plasma stream limited in a medium only by partial discharge in the present embodiment, in the above configuration, the gas supply tube 1 and the gas tube 2 function as a gas stream generating portion that generates a medium gas stream, and the high-potential electrode 3 and the voltage applying unit 4 function as an electric field forming portion that forms an electric field corresponding to each medium gas stream. Due to the electric field formed by the electric field forming portion thus provided, partial discharge occurs on both the upstream side and the downstream side in the medium gas stream, and plasma is produced in the medium gas stream from the electric field forming portion toward both the upstream side and the downstream side in the medium gas stream.

In the above configuration, although the voltage applying unit 4 is configured so as to apply a positive voltage in a pulse train shape with a predetermined frequency to the high-potential electrode 3, the applied voltage is not limited to such a form. The applied voltage may have any form as long as it can generate an electric field so as to cause partial discharge.

It is desired to apply a voltage alternating in time. If a voltage alternating in time is applied, plasma is likely to be produced by the alternating component in the voltage, particularly in the case of dielectric barrier discharge, since plasma is ignited via a capacitor of glass. Specifically, a voltage of about 10 kHz may be used; however, a glow-like atmospheric plasma may be obtained even with a voltage at a low frequency of about 60 Hz. When a voltage at a high frequency of about 10 MHz is used, another discharge shape that is uniform even when viewed in any direction by a high-speed camera is obtained. More preferably, a voltage that changes periodically is applied. This is because stable plasma is obtained more easily with periodical discharge.

Although helium gas is preferred as medium gas, another gas also may be used as long as conditions are set appropriately. For example, a mixed gas of argon and ketone also can be used. Furthermore, various processes can be performed by supplying vapor of a chemical entity such as a monomer, or an aerosol such as sprayed mist and fine particles.

The application of the findings about the above discharge mechanism enables various discharges. The LF plasma jet is a thermally non-equilibrium low-temperature plasma, which can be radiated to a base such as thin nylon without causing any damage but has energy sufficient for effecting a surface treatment, ozone generation, and a plasma polymerization.

According to the configuration in which a non-equilibrium plasma jet is generated by a single electrode, i.e., the single high-potential electrode 3 as in the present embodiment, only partial discharge is allowed to occur without causing short-circuit discharge. The number of the high-potential electrode 3, i.e., the electric field forming portion to be placed with respect to one medium gas stream is not limited to one. More specifically, a plurality of electric field forming portions may be provided with respect to one medium gas stream so that each electric field forming portion causes only partial discharge. Thus, in the configuration in which a plurality of high-potential electrodes 3 are placed at a sufficient distance from each other with respect to one gas stream generating portion, the functional effects of the present embodiment also can be obtained.

In the configuration in which only partial discharge is caused to occur, the increase in power consumption involved in short-circuit discharge is suppressed and the energy conversion efficiency can be enhanced, and further, unnecessary heat generation also can be suppressed, compared with a conventional coaxial 2-electrode system. Furthermore, an electrode on a ground side that contributes less to the generation of a plasma jet is omitted, whereby the apparatus is simplified. The production of a plasma jet can be ignited easily even with a single electrode.

Furthermore, according to a method for producing plasma in a space region limited in a medium by a medium gas flux, any medium gas flux is ionized to become plasma stably by causing only partial discharge. The ignition of plasma can be realized on a wide scale of about 10 μm to 50 mm and the increase in an aperture also is possible principally, using the above procedure.

Furthermore, partial discharge is particularly effective for treating the inner surface of a tube. For treating the inner surface of the tube, using a moving electrode (that is not required to be in contact with the tube), a mixture of helium gas and appropriate monomer gas is allowed flow through the tube (only may fill the tube), and plasma is produced inside the tube. This enables the continuous treatment of the tube. If the procedure in the present embodiment is used, the moving electrode can be configured more easily compared with the 2-electrode system.

As described above, in the LF plasma jet producing apparatus in the present embodiment, only a positive voltage in a pulse train shape is applied to the high-potential electrode 3 connected to the gas supply tube 1 through which the medium gas has been allowed to flow, whereby partial discharge is allowed to occur along the medium gas stream dispersed from the gas supply tube 1 to the atmosphere, which can generate a plasma stream. An example of the setting of various conditions for the generation of a plasma stream is as follows.

Medium gas: helium gas

Inner diameter of a quartz pipe: 3 mm

Flow rate of medium gas: several liters/min.

Voltage applied to the high-potential electrode 3: voltage of 10 kV

Frequency of the applied voltage: 10 KHz

Furthermore, even using an electrode (width: 2 mm, length: 50 mm) having no plane dosed in a rotation angle direction with respect to a medium gas flux (electrode covering only a part), plasma can be produced by partial discharge.

The plasma jet according to the present invention has two characteristics: "generation of a gas flux in the atmosphere" and "partial discharge in the vicinity of a high-potential electrode". Although discharge is allowed to occur by applying a periodical high voltage, plasma parameters can be controlled not only by the applied voltage but also by the applied frequency. The parameters of plasma to be produced can be controlled even by controlling the waveform (polarity) of a high voltage to be applied in addition to the control of the applied voltage and the applied frequency.

Figure 2B:
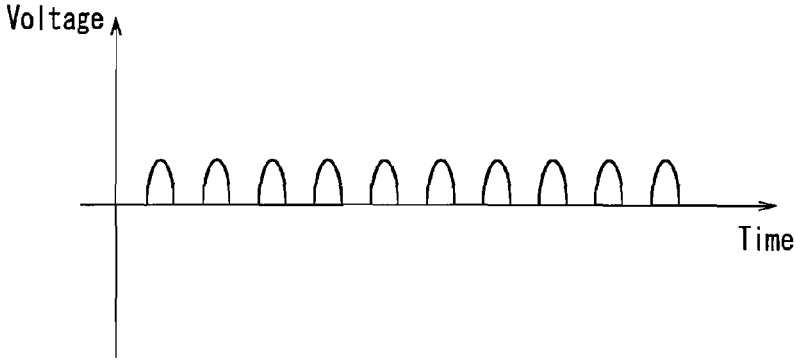
FIG. 2B is a waveform diagram showing a voltage waveform when only a high positive voltage is applied in the LF plasma jet producing apparatus of the present invention.
Figure 2C:
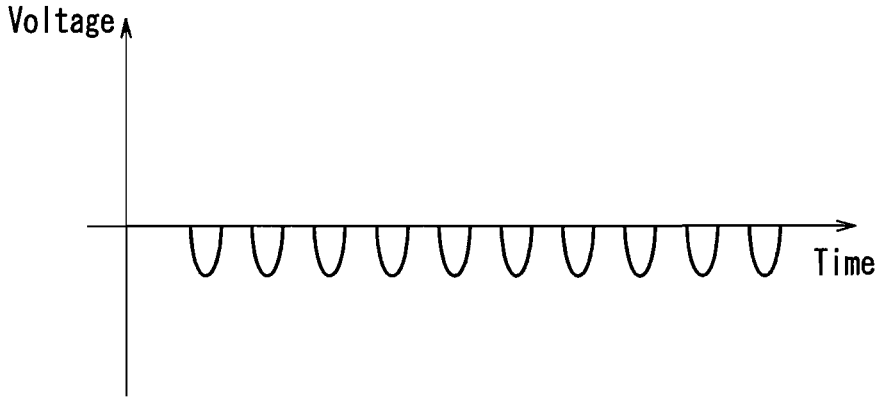
FIG. 2C is a waveform diagram showing a voltage waveform when only a high negative voltage is applied in the LF plasma jet producing apparatus of the present invention.
Figure 2D:
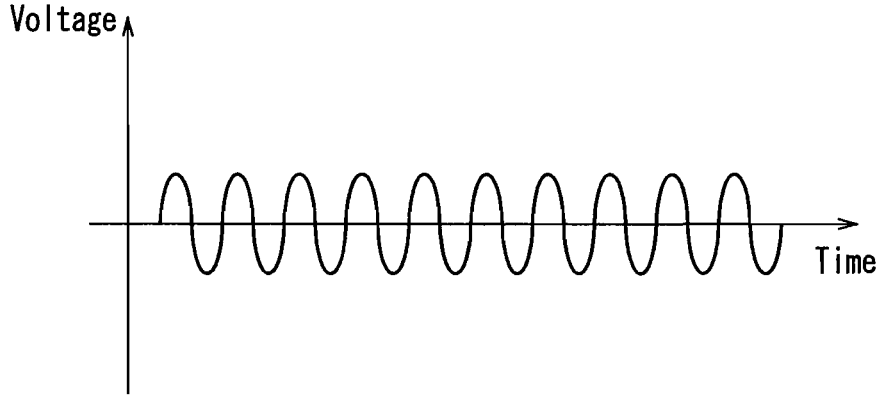
FIG. 2D is a waveform diagram showing a voltage waveform when high positive and negative voltages are applied alternately in the LF plasma jet producing apparatus of the present invention.

The high voltage to be applied actually can be classified into waveforms as shown in FIGS. 2B and 2C. FIG. 2B shows a voltage waveform when only a positive high voltage is applied FIG. 2C shows a voltage waveform when only a negative high voltage is applied FIG. 2D shows a voltage waveform when positive and negative high voltages are applied alternately. In each case, discharge in a pulse shape occurs at a moment when the applied voltage exceeds a predetermined absolute value that varies between the positive and negative voltages. For example, in the case of using a power source of 10 kHz, one period is 100 μsec, and the pulse-shaped discharge is observed within several μsec.

The polarity of the high voltage that is being applied determines the density in the atmosphere, the temperature distribution state, and the like of plasma or ions, electrons, or metastable atoms generated from the plasma. Positive corona discharge occurs in the case of a positive voltage and negative corona discharge occurs in the case of a negative voltage. The positive corona discharge and the negative corona discharge have different physical discharge mechanisms, so that the plasma production state varies. Thus, the use of plasma with each polarity controlled can control the effect of plasma on an object onto which the plasma is radiated. On the other hand, in the case of FIG. 2D, discharge of both the polarities occurs, and each voltage generates positive corona discharge and negative corona discharge successively in a time region in the vicinity of the peak.

By controlling the applied waveforms of positive and negative high voltages in a combination, it can be expected that plasma jets with different parameters are generated and the selective advancement of a chemical reaction is effected.

Figure 2E:
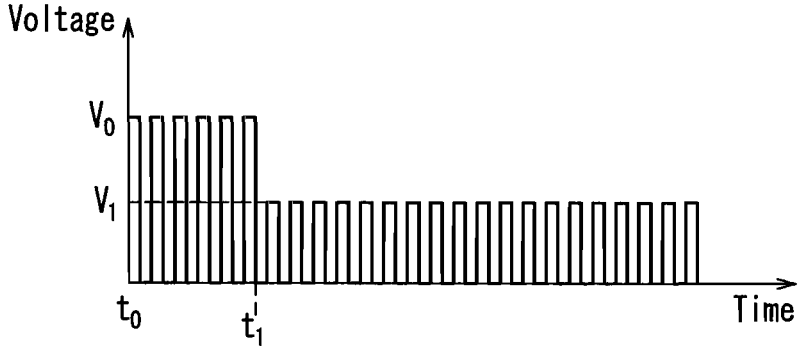
FIG. 2E is a waveform diagram showing another example of a low-frequency voltage to be applied in the LF plasma jet producing apparatus in Embodiment 1.

It is desired that the voltage applying unit 4 is configured so as to change the peak value of an applied voltage at a time of the ignition of plasma and the peak value of an applied voltage at a time of maintaining the production of plasma, as shown in FIG. 2E. More specifically, for igniting the plasma jet, a high peak voltage of V0 is supplied from times t0 to t1, and a reduced peak voltage V1 is supplied after the time t1. The voltage V0 has a level sufficient for igniting a plasma jet and the voltage V is a level required for maintaining the production of a plasma jet. A high voltage is required for the ignition of a plasma jet. Once a plasma jet is produced, the production of the plasma jet can be maintained at a voltage lower than that at a time of the ignition. Therefore, the power consumption can be reduced by decreasing an applied voltage. A similar driving method can be applied to the LF plasma jet producing apparatus in the subsequent embodiments as well.

Furthermore, the high-potential electrode 3 is not required to be provided coaxially on the outer circumferential surface of the gas supply tube 1, and an LF plasma jet can be produced even with an electrode attached to a part of the outer circumferential surface or inner circumferential surface of the gas supply tube 1. More specifically, it is preferred that an electrode is attached to the inner surface or the outer surface of a member made of a dielectric forming a medium gas stream, and the dielectric and the electrode are integrated. When an electrode is attached to the inner surface of a member made of a dielectric, medium gas comes into contact with both the dielectric and the electrode.

Furthermore, the medium gas does not necessarily form a stream. That is, it also is possible to configure a plasma producing apparatus so as to produce plasma from a medium gas mass. In this case, an electric field forming portion that forms an electric field in a medium gas mass is provided. If the medium gas mass has an elongated shape, an electric field is formed so as to cause partial discharge from the electric field forming portion toward both sides in the longitudinal direction of the medium gas mass. The medium gas mass may be configured in such a manner that medium gas is sealed in a tube provided with an electrode. Even in this case, the electrode may be provided on either the inner surface or the outer surface of the tube.

Embodiment 2

Figure 3A:
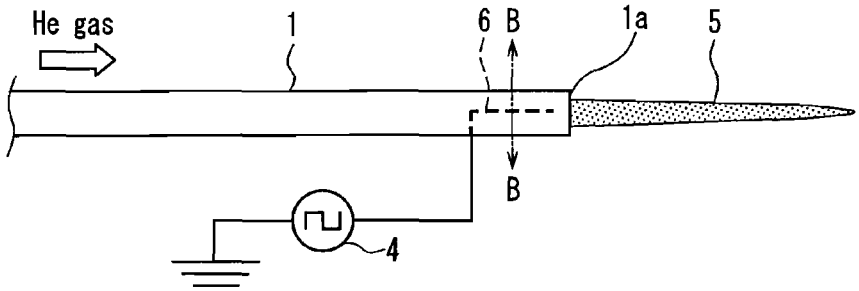
FIG. 3A is a front view of an LF plasma jet producing apparatus in Embodiment 2 of the present invention.
Figure 3B:
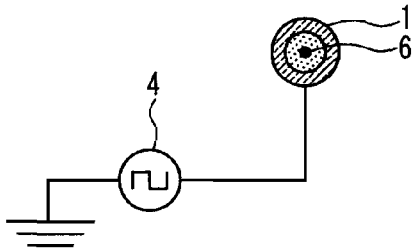
FIG. 3B is an enlarged cross-sectional view taken along a line B-B in the LF plasma jet producing apparatus in FIG. 3A.

FIGS. 3A and 3B show an LF plasma jet producing apparatus in Embodiment 2. FIG. 3A is a front view, and FIG. 3B is an enlarged cross-sectional view taken along a line B-B in FIG. 3A In FIG. 3, the same components as those shown in FIG. 1 are denoted with the same reference numerals as those therein, and the repeated descriptions thereof will be omitted. The same applies to the following description of each embodiment.

In the present embodiment, the gas supply tube 1 is a quartz pipe made of a dielectric, and a high-potential electrode 6 is a copper wire, which is placed on an axis of an internal hollow at an end of the gas supply tube 1 on the jet port 1*a* side. If the high-potential electrode 6 is used, the discharge is started from the tip end of the copper wire that is the high-potential electrode 6. Then, a jet extending in an elongated shape increases in a radius gradually toward the jet port 1*a* of the gas supply tube 1.

Figure 4:
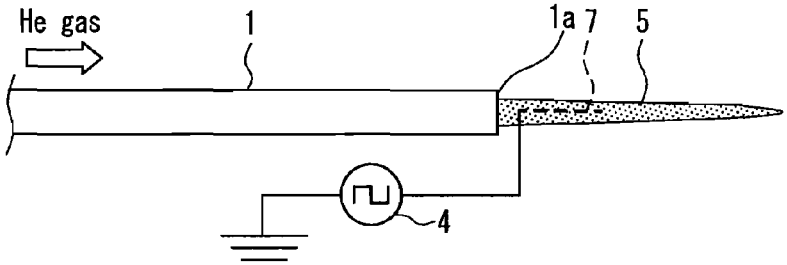
FIG. 4 is a front view showing a modified example of the LF plasma jet producing apparatus in Embodiment 2.

As shown in FIG. 4, a high-potential electrode 7 made of a copper wire also can be placed away from the gas supply tube 1. More specifically, the linear high-potential electrode 7 is placed at a position away from the end of the gas supply tube 1 on the jet port 1*a* side in the jetting direction of the medium gas stream.

Furthermore, a coaxial electrode also can be placed on an inner circumferential surface of the end of the gas supply tube 1 on the jet port 1*a* side in place of the linear high-potential electrode 6. Alternatively, even if an electrode is placed in a part of the inner circumferential surface, a non-equilibrium plasma jet can be produced.

Embodiment 3

As described above, according to the present invention, a single high-potential electrode may be provided, which increases the degree of freedom of the setting of the electrode. For example, a plasma jet also can be generated using a gas supply tube made of metal as an electrode, in place of attaching an electrode to a gas supply tube made of a dielectric, as in the present embodiment.

Figure 5A:
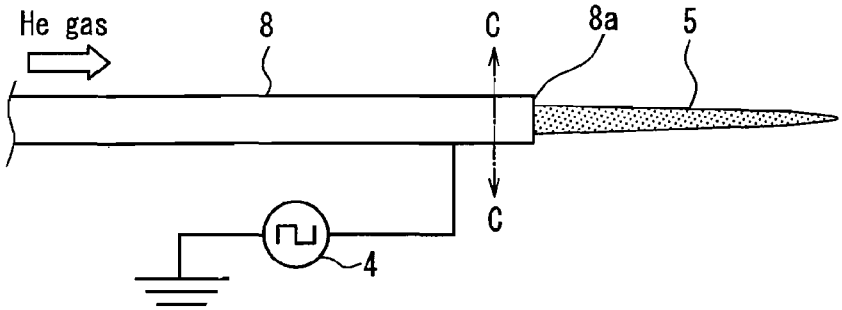
FIG. 5A is a front view of an LF plasma jet producing apparatus in Embodiment 3 of the present invention.
Figure 5B:
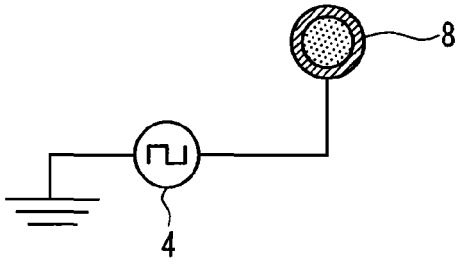
FIG. 5B is an enlarged cross-sectional view taken along a line C-C in the LF plasma jet producing apparatus in FIG. 5A.

FIGS. 5A and 5B show an LF plasma jet producing apparatus in Embodiment 3. FIG. 5A is a front view and FIG. 5B is an enlarged cross-sectional view taken along a line C-C in FIG. 5A In the present embodiment, a gas supply tube is formed of a metal pipe 8 made of a conductive material. The metal pipe 8 is connected to the voltage applying unit 4 and used as a high-potential electrode for producing plasma for applying a positive voltage in a pulse train shape with a predetermined frequency. A plasma jet of a micro size also can be generated, using a metal tube with an inner diameter of about several millimeters, needless to say, or a stainless pipe with an inner diameter of 100 μm as the metal pipe 8.

Embodiment 4

Figure 6A:
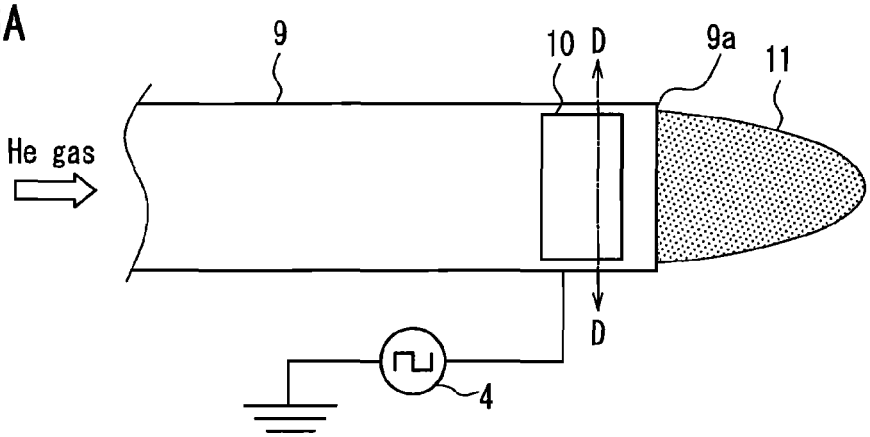
FIG. 6A is a front view of an LF plasma jet producing apparatus in Embodiment 4 of the present invention.
Figure 6B:
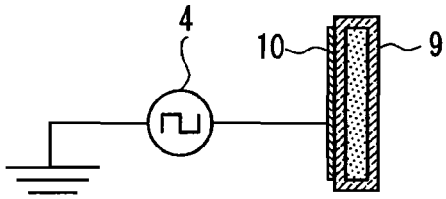
FIG. 6B is an enlarged cross-sectional view taken along a line D-D in the LF plasma jet producing apparatus in FIG. 6A.

FIGS. 6A and 6B show an LF plasma jet producing apparatus in Embodiment 4. FIG. 6A is a front view and a FIG. 6B is an enlarged cross-sectional view taken along a line D-D in FIG. 6A.

In the present embodiment, the cross-section of a flat plate-shaped quartz pipe constituting a flat plate-shaped gas supply tube 9 has a flat plate shape instead of the cylindrical shape, as shown in FIG. 6B. Thus, a jet port 9*a* has a linear opening. A high-potential electrode 10 also has a flat plate shape, and is attached to one outer surface of the flat plate-shaped gas supply tube 9.

The LF plasma jet producing apparatus can be enlarged compared with the above embodiments. For example, a non-equilibrium plasma jet 11 in a plane shape of about 2 mm×50 mm can be formed, which is suitable for the treatment of a large area.

Furthermore, as the gas supply tube, a plastic pipe, a metal pipe, or the like can be used in place of the quartz pipe.

Embodiment 5

Figure 7:
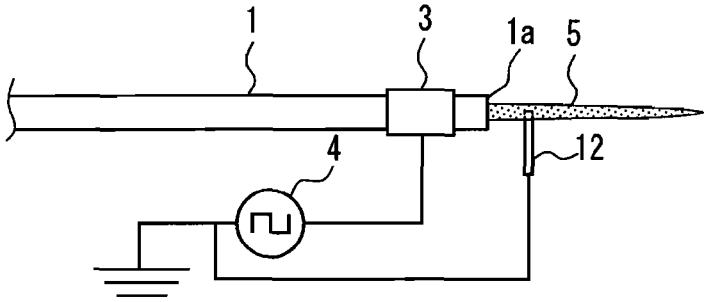
FIG. 7 is a front view of the LF plasma jet producing apparatus in Embodiment 5 of the present invention.

FIG. 7 is a front view showing an LF plasma jet producing apparatus in Embodiment 5. The basic configuration of the LF plasma jet producing apparatus in Embodiment 5 is similar to that of the apparatus in Embodiment 1 shown in FIGS. 1A and 1B.

The coaxial single high-potential electrode 3 for producing plasma is set on an outer circumference of an end of the gas supply tube 1 on the jet port 1*a* side. The voltage applying unit 4 is connected to the high-potential electrode 3 and can apply a positive voltage in a pulse train shape with a predetermined frequency. The present embodiment is characterized in that an auxiliary electrode 12 further is placed in the vicinity of the jet port 1*a*, and is connected to the ground side of the voltage applying unit 4.

If medium gas (for example, helium gas) is jetted from the jet port 1*a* using the gas supply tube 1 to form a gas stream of the medium gas, and for example, a positive voltage in a pulse train shape of 10 kV is applied with a frequency of about 10 kHz by the voltage applying unit 4, a non-equilibrium plasma jet 5 that extends in an elongated shape from the jet port 1*a* is generated. At this time, the auxiliary electrode 12 that is grounded is present, which facilitates the ignition of plasma and enhances the stability of maintaining the production of plasma. More specifically, an applied voltage at a time of the ignition of plasma can be reduced to a voltage low enough for maintaining the production of plasma, and the production of plasma can be maintained stably at a sufficiently low voltage.

The auxiliary electrode 12 is placed so as to have such a size as to come into contact with a part of the medium gas stream jetted from the jet port 1*a*. Thus, the effects of igniting and maintaining plasma can be obtained without having a substantial effect on the generation of the non-equilibrium plasma jet 5.

Embodiment 6

Figure 8A:
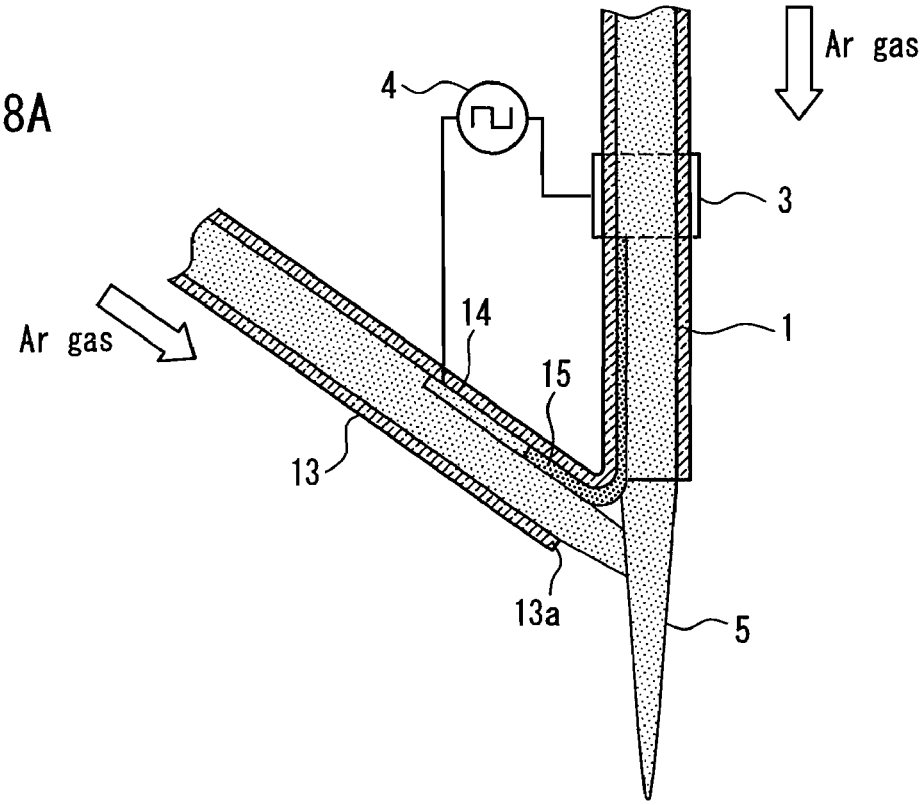
FIG. 8A is a front view of an LF plasma jet producing apparatus in Embodiment 6 of the present invention.

FIG. 8A is a front view showing an LF plasma jet producing apparatus in Embodiment 6. The basic configuration of the LF plasma jet producing apparatus in the present embodiment is similar to that of the apparatus in Embodiment 1 shown in FIGS. 1A and 1B. More specifically, the coaxial single high-potential electrode 3 for producing plasma is set on an outer circumference of an end of the gas supply tube 1 on the jet port 1*a* side. The high-potential electrode 3 is connected to the voltage applying unit 4, and can apply a high potential in a pulse train shape with a predetermined frequency.

The present embodiment is characterized in that an auxiliary gas supply tube 13 further is provided adjacent to the jet port 1*a* of the gas supply tube 1. An auxiliary electrode 14 is placed in the internal hollow of the auxiliary gas supply tube 13, and is connected to the ground side of the voltage applying unit 4. The auxiliary electrode 14 is placed dose to the tube wall of the auxiliary gas supply tube 13 on the gas supply tube 1 side.

Figure 8B:
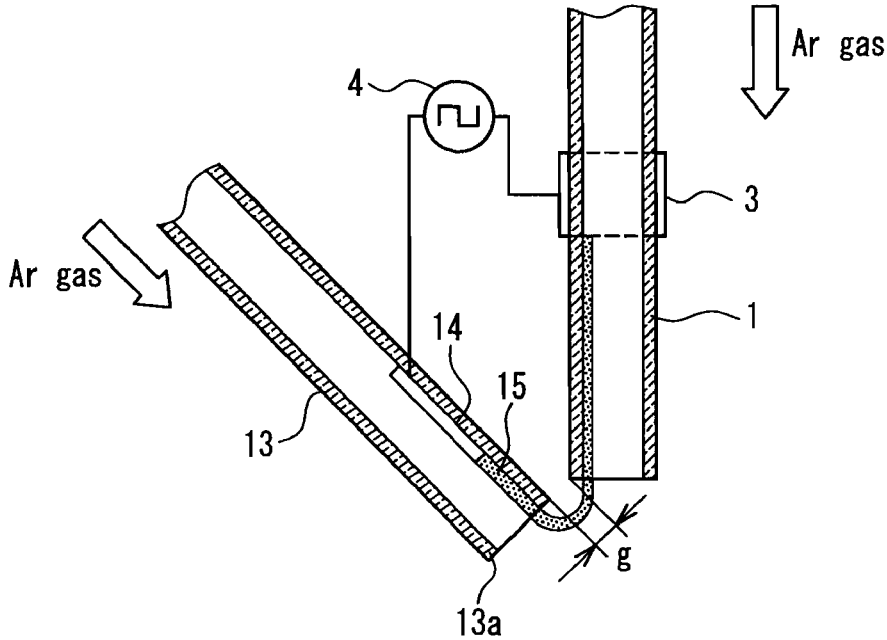
FIG. 8B is a front view showing another aspect of the LF plasma jet producing apparatus in Embodiment 6.

The auxiliary gas supply tube 13 is placed diagonally at an acute angle with respect to the gas supply tube 1, and a jet port 13*a* is placed adjacent to the jet port 1*a* of the gas supply tube 1. The jet port 13*a* being placed adjacent to the jet port 1*a* includes the state in which the they are in contact with each other as shown in FIG. 8A or the state in which they are placed dose to each other so as not to be in contact with each other as shown in FIG. 8B. The allowable upper limit of an interval g when the jet port 13*a* and the jet port 1*a* are placed dose to each other so as not to be in contact with each other is determined by the range in which the effect described later can be obtained sufficiently from the practical viewpoint. FIG. 8B shows only surface creepage 15 for convenience of the drawings, and the plasma jet 5 is not shown.

When argon gas, for example, is allowed to flow as medium gas, using the apparatus with the above configuration, and a low-frequency voltage similar to that in Embodiment 1 is applied between the high-potential electrode 3 and the auxiliary electrode 14 by the voltage applying unit 4, the plasma jet 5 can be ignited easily and maintained stably. The reason for this is as follows.

The LF plasma jet is generated by partial discharge instead of short-circuit discharge. The partial discharge is caused by the concentration of an electric field in the vicinity of a high-potential electrode, and therefore, for the production of plasma, a higher voltage is required, compared with that in short-circuit discharge. When helium is used as medium gas, an LF plasma jet can be ignited and maintained at a relatively low voltage. In contrast, argon gas has a higher discharge starting voltage, compared with that of helium gas, so that it is necessary to apply a relatively high voltage. As a result, strong discharge occurs along with the start of discharge. In other words, it is difficult to ignite and maintain an LF plasma jet in argon gas at a low voltage that causes weak discharge which does not impair the features of the LF plasma jet.

In contrast, in the LF plasma jet producing apparatus with the above configuration, the discharge start voltage in the case of using argon gas as medium gas can be decreased by providing the auxiliary gas supply tube 13 having the auxiliary electrode 14. This is ascribed to the fact that the surface creepage 15 first occurs between the high-potential electrode 3 and the auxiliary electrode 14 when a voltage is applied. The surface creepage 15 is a discharge phenomenon along the surface of a solid, and long-distance discharge can be performed at a relatively lower voltage compared with that of the discharge in gas. More specifically, discharge is started at a lower voltage, compared with the partial discharge in a medium gas stream of argon jetted from the gas supply tube 1 by the high-potential electrode 3.

This is because electrons, radicals, UV-rays, or the like are supplied to the periphery by the surface creepage 15, and the discharge start conditions in the peripheral portion become loose. Consequently, even at an applied voltage at which partial discharge is unlikely to occur in a medium gas stream of argon jetted from the gas supply tube 1, the partial discharge by the high-potential electrode 3, i.e., the production of an LF plasma jet is likely to start and the production of plasma can be maintained stably.

The configuration of the present embodiment is effective even when helium gas is used as a medium, because the discharge start voltage is decreased further, and the discharge can be maintained at a lower voltage stably.

As shown in FIG. 8B, the allowable upper limit of the interval g when the jet port 13*a* and the jet port 1*a* are placed dose to each other so as not to be in contact with each other varies depending upon various conditions. If the interval g is set so as to satisfy the condition represented by the following Expression (1), the auxiliary effects by the surface creepage can be obtained sufficiently from the practical viewpoint. In Expression (1), L represents the length of a path over which the surface creepage 15 occurs along the inner wall of the gas supply tube 1 and the auxiliary gas supply tube 13.

$$g/L \leqq 0.1 \quad (1)$$

Strictly, the value of g/L may be set so that the total of the breakdown voltages in the surface portion and the spatial short-circuit portion is below the applied voltage. However, generally, the spatial breakdown voltage is much higher than the surface breakdown voltage. Therefore, if the total of the breakdown voltages is set in the range represented by Expression (1), practical effects can be obtained.

In the LF plasma jet producing apparatus, surface creepage is allowed to occur along a glass wall by the configuration of a single-sided barrier, in which the high-potential electrode 3 applies a voltage to medium gas, using a glass wall of the gas supply tube 1 as a dielectric barrier, and the auxiliary electrode 14 applies a voltage to medium gas not through the dielectric barrier. On the other hand, surface creepage also can be caused along the glass wall by the configuration of a double-sided barrier, in which the auxiliary electrode 14 also applies a voltage to medium gas, using the glass wall of the auxiliary gas supply tube 13 as a dielectric barrier.

Furthermore, in the above configuration, the auxiliary electrode 14 is placed so as to be biased with respect to a tube axis of the auxiliary gas supply tube 13. However, the auxiliary electrode 14 may be placed at any arrangement, as long as surface creepage is allowed to occur.

Embodiment 7

A method for producing an LF plasma jet in Embodiment 7 will be described. The LF plasma jet production method in Embodiment 7 is basically similar to that described in Embodiment 1 with reference to FIGS. 1A and 1B. More specifically, medium gas (for example, helium gas) is jetted from the jet port 1*a*, using the gas supply tube 1, to form a gas stream of medium gas. The single high-potential electrode 3 is placed so as to be in contact with or adjacent to the medium gas stream, and a positive voltage in a pulse train shape with a predetermined frequency is applied to the high-potential electrode, whereby plasma 5 is produced in the medium gas stream.

Figure 9A:
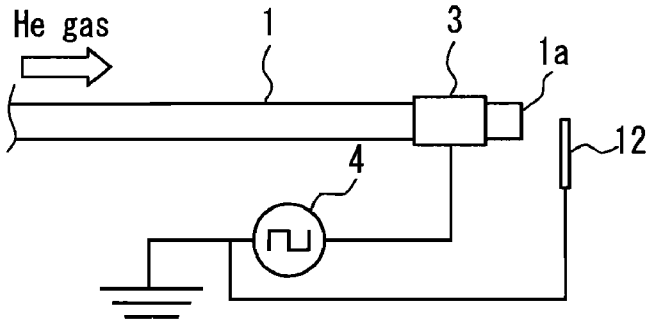
FIG. 9A is a front view showing a first step of an LF plasma jet production method in Embodiment 7 of the present invention.
Figure 9B:
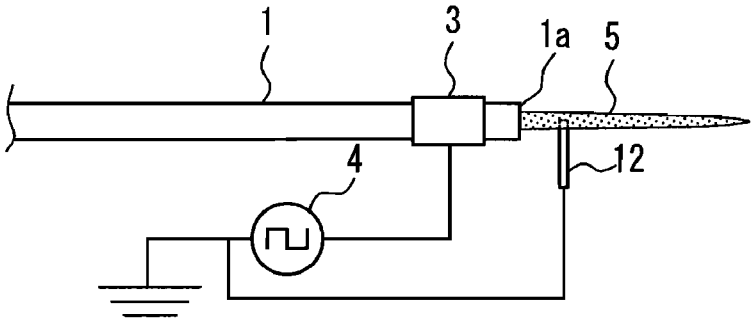
FIG. 9B is a front view showing a second step of the LF plasma jet production method in Embodiment 7 of the present invention.
Figure 9C:
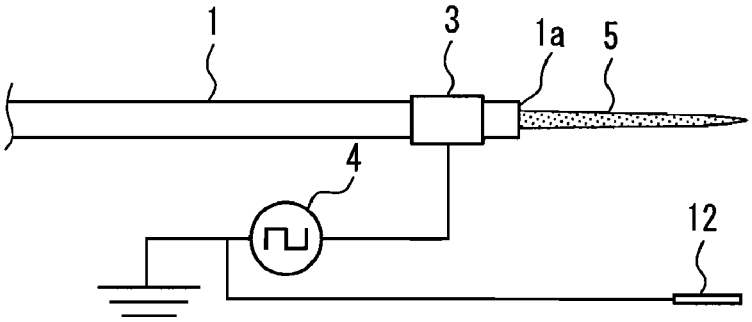
FIG. 9C is a front view showing a third step of the LF plasma jet production method in Embodiment 7 of the present invention.

A method obtained by modifying the above basic LF plasma jet production method so as to facilitate the ignition further will be described with reference to front views of FIGS. 9A to 9C showing the steps of the production method.

First, as shown in FIG. 9A, a predetermined pulse voltage for driving is applied to the high-potential electrode 3 by the voltage applying unit 4, and the electrode 12 connected to the ground side of the voltage applying unit 4 is placed in the vicinity of the jet port 1*a* of the gas supply tube 1.

Then, as shown in FIG. 9B, if helium gas is jetted from the jet port 1*a* of the gas supply tube 1, the production of non-equilibrium plasma jet is started. Next, as shown in FIG. 9C, the electrode 12 at a ground potential is placed apart from the single electrode. If the application of a pulse voltage from the voltage applying unit 4 to the high-potential electrode 3 is continued, the production of non-equilibrium plasma jet is maintained.

Thus, the applied voltage at a time of the ignition of a plasma jet can be reduced to a voltage lower enough to maintain the production of a plasma jet, which is effective for the miniaturization of the voltage applying unit 4.

Embodiment 8

Figure 10:
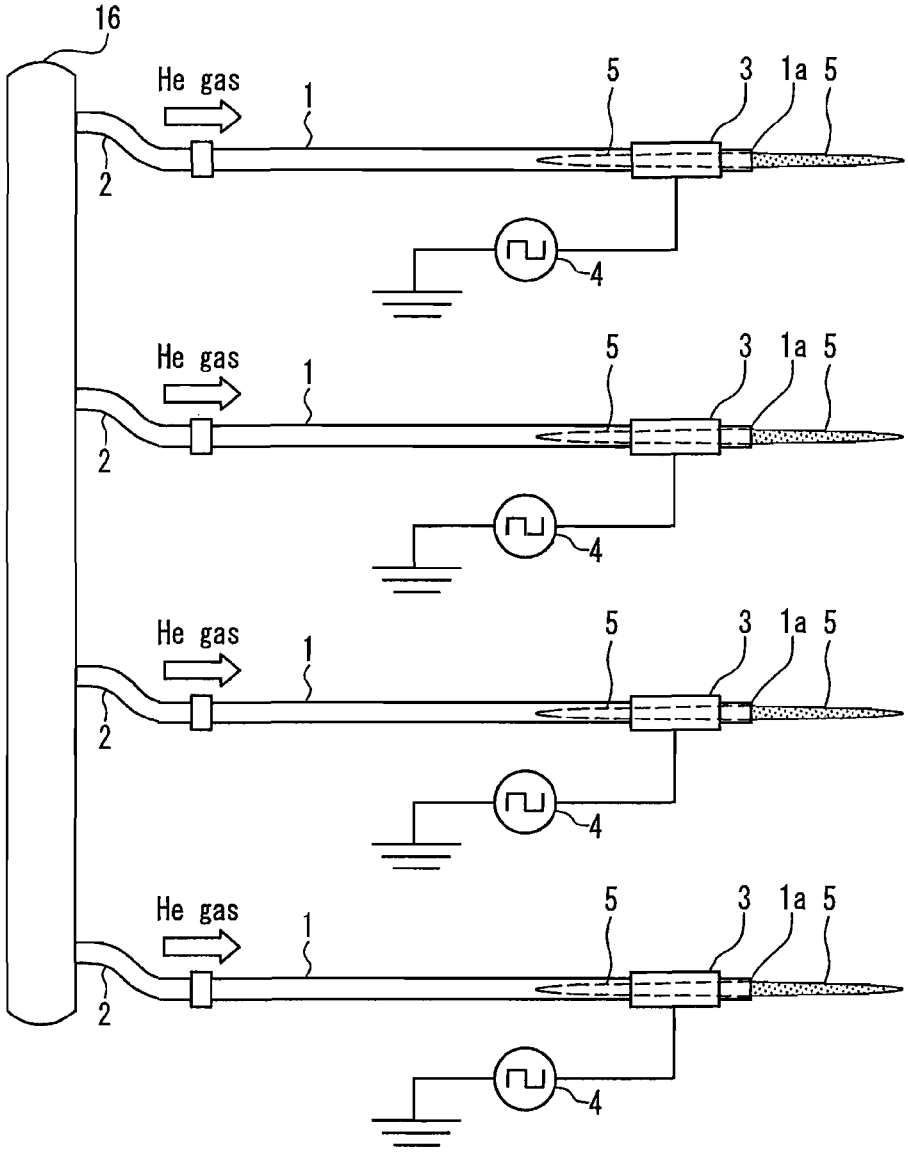
FIG. 10 is a front view showing an LF plasma jet producing apparatus in Embodiment 8 of the present invention.
Figure 11:
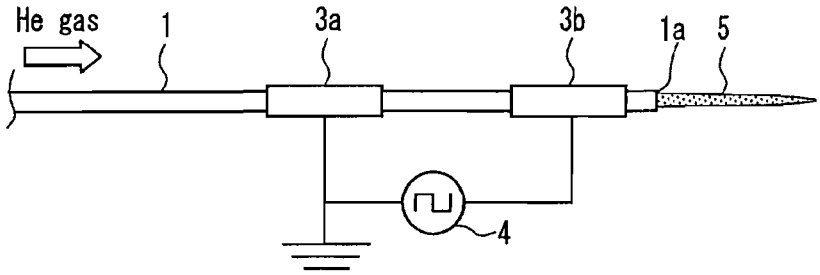
FIG. 11 PRIOR ART
FIG. 11 is a front view showing an LF jet producing apparatus in a conventional example.

FIG. 10 is a front view showing an LF plasma jet producing apparatus in Embodiment 8. In Embodiment 8, four plasma jet producing units having a configuration similar to that shown in FIG. 1A are placed, and He gas is supplied from a common medium gas source 16 to each unit. The voltage applying unit 4 is provided for each unit.

INDUSTRIAL APPLICABILITY

A plasma producing apparatus of the present invention is capable of generating a plasma stream stably with a wide range of parameters through a simple discharge mechanism, and is applicable to a wide range of uses including the surface treatment of plastic, the oxidation reaction of a lysate in a solution, and the plasma polymerization of a liquid monomer.

The invention claimed is:

1. A plasma producing apparatus that produces plasma from medium gas, comprising:

a gas supply tube made of a dielectric material that supplies the medium gas so as to generate a medium gas stream having an elongated shape, a single high-potential electrode that is provided outside of the gas supply tube so as to form an electric field in the medium gas; and a voltage applying element that applies a voltage to the high-potential electrode, wherein the voltage is set to be in a range with which partial discharge based on dielectric barrier discharge occurs from the high-potential electrode toward both an upstream side and a downstream side in the medium gas stream, due to the electric field that is formed between the high-potential electrode and a ground potential present around the high-potential electrode through the dielectric material of the gas supply tube, and the partial discharge causes the plasma to be produced in the medium gas stream.

2. The plasma producing apparatus according to claim 1, wherein the voltage applying element is capable of supplying a voltage capable of starting partial discharge in the medium gas and a voltage capable of maintaining the partial discharge.

3. The plasma producing apparatus according to claim 1, further comprising an auxiliary electrode placed at a position apart from the high-potential electrode so as to be adjacent to a part of the medium gas, wherein the auxiliary electrode is supplied with a ground potential from the voltage applying element.

4. The plasma producing apparatus according to claim 1, further comprising:

an auxiliary gas supply tube that guides the medium gas; and an auxiliary electrode that is provided in the auxiliary gas supply tube and is supplied with a ground potential by the voltage applying element, wherein the auxiliary gas supply tube is placed so that a jet port for jetting the medium gas is in contact with a jet port for jetting the medium gas of the gas supply tube or is close to the jet port for jetting the medium gas of the gas supply tube at a predetermined interval g.

5. The plasma producing apparatus according to claim 1, wherein a plurality of the gas supply tubes are provided so as to generate a plurality of the medium gas streams, and each of the gas supply tubes is provided with a single high-potential electrode, thereby producing plasma in each of the medium gas streams.

6. The plasma producing apparatus according to claim 1, wherein the gas supply tube has an opening in a flat plate shape, through which the medium gas is released, and the high-potential electrode is provided in a flat plate shape on a plate surface of the opening.

7. The plasma producing apparatus according to claim 1, wherein the gas supply tube has a cylindrical structure, and the high-potential electrode has a cylindrical structure.

8. A method of plasma production for producing plasma from medium gas, comprising:

supplying the medium gas through a gas supply tube made of a dielectric material so as to generate a medium gas stream having an elongated shape;

placing a single high-potential electrode outside of the gas supply tube so as to form an electric field in the medium gas; and applying a voltage, which forms an electric field causing partial discharge based on dielectric barrier discharge from the high-potential electrode toward both an upstream side and a downstream side of the medium gas stream, to the high-potential electrode, in which the electric field is formed between the high-potential electrode and a ground potential present around the high-potential electrode through the dielectric material of the gas supply tube, the partial discharge causing the plasma to be produced in the medium gas stream.

9. The method of plasma production according to claim 8, comprising, for forming the electric field by the high-potential electrode:

setting a distance between the high-potential electrode and a ground potential portion to be a predetermined distance at which the voltage applied to the high-potential electrode is capable of starting the partial discharge, and setting a distance between the high-potential electrode and the ground potential portion to be larger than the predetermined distance in a range capable of maintaining the partial discharge.

* * * * *